United States Patent [19]

Sato et al.

[11] Patent Number: 4,568,793

[45] Date of Patent: Feb. 4, 1986

[54] ELECTRICAL INSULATING OIL AND OIL-FILLED ELECTRICAL APPLIANCES

[75] Inventors: Atsushi Sato, Tokyo; Shigenobu Kawakami, Ichikawa; Hideyuki Dohi, Tokyo; Keiji Endo, Yokosuka, all of Japan

[73] Assignee: Nippon Petrochemical Company, Limited, Japan

[21] Appl. No.: 747,659

[22] Filed: Jun. 21, 1985

[30] Foreign Application Priority Data

Jun. 29, 1984 [JP] Japan ..... 59-135541

[51] Int. Cl.[4] ..... H01B 3/24

[52] U.S. Cl. ..... 174/25 C; 361/327; 585/24; 585/25; 585/467

[58] Field of Search ..... 174/25 C; 361/327; 585/24, 25, 455, 467

[56] References Cited

U.S. PATENT DOCUMENTS

| | | | |
|---|---|---|---|
| 2,933,450 | 4/1960 | Lyding | 585/25 |
| 4,111,824 | 9/1978 | Schulz et al. | 585/25 |
| 4,111,825 | 9/1978 | Schulz et al. | 585/25 |
| 4,238,343 | 12/1980 | Pellegrini et al. | 585/24 |
| 4,493,943 | 1/1985 | Sato et al. | 585/25 |

FOREIGN PATENT DOCUMENTS

| | | | |
|---|---|---|---|
| 6018312 | 7/1979 | Japan | 174/25 C |
| 557321 | 11/1943 | United Kingdom | 174/25 C |
| 896065 | 5/1962 | United Kingdom | 174/25 C |
| 1142047 | 2/1969 | United Kingdom | 174/25 C |

*Primary Examiner*—John Doll
*Assistant Examiner*—A. Pal
*Attorney, Agent, or Firm*—Scully, Scott, Murphy & Presser

[57] ABSTRACT

An electrical insulating oil which can be produced easily at low cost, scarcely contains undesirable components of tarry substance, unsaturated compounds and carbonyl compounds, does neither swell nor dissolve plastic materials, and has excellent electrical properties. The electrical insulating oil is characterized in that it comprises a fraction having boiling points in the range of 270° to 350° C. which is prepared by distilling the heavier products obtained from the process for producing ethyltoluene by alkylating toluene with ethylene in the presence of synthetic zeolite catalyst. Included also in the present invention are oil-filled electrical appliances that are produced by impregnating them with the above insulating oil.

13 Claims, No Drawings

ELECTRICAL INSULATING OIL AND OIL-FILLED ELECTRICAL APPLIANCES

BACKGROUND OF THE INVENTION (1) Field of the Invention

This invention relates to an electrical insulating oil and oil-filled electrical appliances impregnated therewith. More particularly, the invention relates to an electrical insulating oil which is prepared from a heavier product that is obtained in the ethyltoluene production process.

(2) Description of the Prior Art

Oil-filled electrical appliances such as oil-filled capacitors recently have a marked tendency to be made small in size and light in weight. In compliance with this trend, various kinds of plastic materials have been developed as insulating materials and dielectric materials. They are used in place of or in combination with the conventionally used insulating paper.

In connection with electrical insulating oils to be used for impregnating the oil-filled electrical appliances, several problems have arisen with the increasing use of the plastic materials. That is, the compatibility of conventional electrical insulating oils such as refined mineral oils, polybutenes and alkylbenzenes with plastic materials such as polyolefins is not always satisfactory. The conventional electrical insulating oils tend to dissolve or swell the plastic materials and sometimes impair the dielectric strength of oil-filled electrical appliances.

Accordingly, proposals on improved electrical insulating oils for impregnating oil-filled electrical appliances using plastic materials such as polyolefin, are eagerly awaited.

For the purpose to produce ethylbenzene, ethyltoluene and cumene, it has been widely put into industrial practice that hydrocarbons such as benzene and toluene are alkylated with olefins such as ethylene and propylene in the presence of alkylation catalysts to obtain alkylbenzenes. In this process, various kinds of alkylation catalysts such as aluminum chloride, solid phosphoric acid, and boron fluoride are used.

In the above alkylation process, a heavier by-product fraction containing diarylalkanes, triaryldialkanes and other impurities having chemical structures that correspond to the kinds of starting materials and alkylation catalyst, is obtained. For example, as disclosed in U.S. Pat. Nos. 4,108,788; 4,111,824 and 4,111,825, it is known that the heavier product that is obtained from a process to alkylate benzene with ethylene in the presence of aluminum chloride catalyst, can be used as an electrical insulating oil for general purposes.

The electrical insulating oil comprising the above fraction disclosed in the foregoing references is, however, not always satisfactory as an impregnating oil for oil-filled electrical appliances because the pour point of the fraction is relatively high and it contains tarry substances, unsaturated compounds and carbonyl compounds that cannot be easily removed only by distillation. Even when it is treated by refining, it is not suitable for use under severe conditions. Furthermore, because it swells plastic materials such as polyolefin to a considerable extent, it is not suitable for impregnating oil-filled electrical appliances that are made by using plastic materials.

As described above, the electrical insulating oils of this kind are not satisfactory because they contain tarry substances, unsaturated compounds and carbonyl compounds that cannot easily be removed by distillation. Furthermore, the compatibility of them with plastic materials is not good.

BRIEF SUMMARY OF THE INVENTION

The present inventors have found that the fraction obtained from the heavier product in alkylation process using toluene and ethylene as starting materials in the presence of synthetic zeolite as an alkylation catalyst, is quite suitable for use in impregnating electrical appliances as compared with the fractions disclosed in the foregoing patent publications.

It is, therefore, the primary object of the present invention to provide a novel and improved electrical insulating oil which is free from the above-described disadvantages in the conventional art.

Another object of the present invention is to provide an electrical insulating oil and oil-filled electrical appliances impregnated therewith, which oil is suitable for use as an impregnation oil for oil-filled electrical appliances such as oil-filled capacitors and oil-filled cables in which a plastic material such as polyolefin is used for at least a part of the insulating material or the dielectric material.

According to the present invention, the electrical insulating oil is characterized in that the electrical insulating oil comprises a fraction having boiling points in the range of 270° to 350° C. which fraction is obtained by distilling the heavier products obtained from the process for producing ethyltoluene by alkylating toluene with ethylene in the presence of synthetic zeolite catalyst.

DETAILED DESCRIPTION OF THE INVENTION

The foregoing alkylation catalyst is a synthetic zeolite catalyst, that is, crystalline aluminosilicate zeolite. Preferable ones are ZSM-5 type synthetic zeolites such as those known as ZSM-5 zeolite and ZSM-11 zeolite. These ZSM-5 type synthetic zeolites are described in the following patent specifications.

ZSM-5:

U.S. Pat. No. 3,702,886

British Pat. No. 1,161,974

ZSM-11:

U.S. Pat. No. 3,709,979

The molar ratio as $SiO_2/Al_2O_3$ of ZSM-5 type synthetic zeolite is generally in the range of 20 to 400 and the zeolite shows a specific X-ray diffraction pattern. (cf: The above patent publications)

The synthetic zeolite suitably used in the present invention is the one which is ion-exchanged with hydrogen ionsC, divalent ions such as magnesium, potassium, strontium and barium, and trivalent ions such as rare earth elements of cerium and yttrium. Furthermore, synthetic zeolite which is modified with boron, gallium, phosphorus or their compounds can be used.

Though the alkylation can be carried out in a liquid phase, it is generally done in a gaseous phase at temperatures in the range of 300° to 650° C., preferably 350° to 550° C. Below the above temperature range, the alkylation reaction does not easily proceed, and above the said temperature range, cracking reaction or the like occurs. The pressure for the alkylation is not especially limited, but it may be in the range of 1 to 100 kg/cm$^2$ and it is generally performed at atmospheric pressure. The preferable molar ratio of the starting materials, ethylene/-toluene, is in the range of 0.05 to 10. The value of WHSV is 1 to 500 and preferably 1 to 300.

In the above alkylation process, a reaction mixture containing unreacted toluene, ethyltoluene, polyethyltoluene and heavier products is obtained. The above unreacted toluene, ethyltoluene and polyethyltoluene are then removed from this reaction mixture by distillation to obtain heavier products having boiling points of 250° C. or higher.

Because of the use of synthetic zeolite as an alkylation catalyst, the quantity of tarry substance contained in the heavier product is very small which fact is quite different from the reaction in which aluminum chloride catalyst is used. Furthermore, the quantities of unsaturated compounds and carbonyl compounds that will impair the thermal stability are also very small. It is, however, possible to subject the heavier products to refining treatment, if desired. Agents and conditions for this refining treatment are not different from those which are generally employed for treating conventional electrical insulating oils. For example, any of acid treatment with activated clay or sulfuric acid, or alkali treatment with alkali metal hydroxide or alkaline earth metal hydroxide may be used. It is possible to apply this refining treatment after the next distillation step.

In the next step, a fraction having boiling points in the range of 270° to 350° C., preferably 275° to 320° C. is obtained by distilling the foregoing heavier products. Components having boiling points below 270° C. or above 350° C. are not desirable because they impair the compatibility with plastic materials and the electrical characteristics.

The fraction obtained through the above-described procedure contains diarylalkanes as main components, which diarylalkanes are represented by the molecular formula:

$$C_nH_{2n-14}$$

(n=14 to 16), and
by the following structural formula (I):

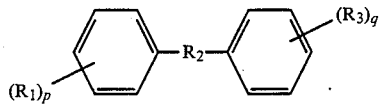

(I)

wherein each $R_1$ and $R_3$ is a hydrogen atom, a methyl group or an ethyl group and $R_2$ is a methylene group, ethylene group or ethylidene group, and p and q are integers from 1 to 3.

The above fraction of the present invention may be used singly or mixed with other known electrical insulating oils such as diarylalkanes, alkylbiphenyls or alkylnaphthalenes in an arbitrary proportion as far as the effects of the present invention can be obtained.

As compared with the fraction that is obtained by using aluminum chloride catalyst, the above-described fraction according to the present invention is characterized in that it scarcely contains tarry substances, unsaturated compounds and carbonyl compounds. Furthermore, as it does not cause marked swelling of plastic materials, it is quite suitable for use in oil-filled electrical appliances such as oil-filled capacitors and oil-filled cables in which a plastic material is used at least partially as an electrical insulating material or a dielectric material.

In the oil-filled capacitors of this kind, a metal foil such as aluminum foil as an electrode and a plastic film as a dielectric material are wound together to form a capacitor element and then an electrical insulating oil is impregnated to the capacitor element. It is possible to use insulating paper together with the plastic film. In place of the metal foil, a metallized plastic film which is applied with a metallic vacuum evaporation coating layer as an electrode can also be used. As the plastic films, those made of polyolefins such as polyethylene and polypropylene, polyester and polyvinylidene fluoride can be used. Among them, the polyolefin, especially polypropylene is preferable.

In the above oil-filled cables, a plastic film as an insulating material is wound around a conductor made of a metal such as copper or aluminum and then it is impregnated with an electrical insulating oil. As the insulating material, the combination of a plastic film and insulating paper can also be used. For example, there are composite films in which a plastic film is laminated with insulating paper by melt-extrusion, composite films in which silane cross-linked plastic is joined to insulating paper, and mixed fiber paper made of pulp and plastic fiber. As plastics, polyolefins such as polyethylene and polypropylene, polyester and polyvinylidene fluoride can be used. Among them, the polyolefin, especially polypropylene, is preferable.

The use conditions for these oil-filled electrical appliances are quite severe because long time electric loads are applied at higher voltages. Accordingly, when impurities are contained in electrical insulating oils to be impregnated, the influence of the impurities is quite large. The above fraction according to the present invention scarcely contains unsaturated compounds and carbonyl compounds because the synthetic zeolite catalyst is used in the preparation process. Therefore, the oil-filled electrical appliances that are impregnated with this fraction can maintain their stable electrical characteristics for a long period of time.

In the case that an impregnating oil causes swelling or dissolving of the plastic material in an electrical appliance, or the impregnating property to the plastic material is insufficient, it is not desirable because insufficiently impregnated portions form voids which cause electric convergences in electric capacitors, or such portions block oil flows in cables. It should be noted, however, that the foregoing fraction according to the present invention hardly swells or dissolves plastic materials, and the impregnating property with regard to plastic materials is quite good. Accordingly, capacitors and cables that are impregnated with the fraction of the invention are quite stable even under high voltage loads.

As described above, because the quantities of tarry substances, carbonyl compounds and unsaturated compounds in the fraction of the present invention are smaller and the main components in the fraction of the present invention are also different as compared with the fractions obtained by using aluminum chloride catalyst, the fraction of the invention does not swell plastics undesirably and the electrical characteristics thereof are good. Therefore, the fraction of the invention is suitable as an impregnating oil for oil-filled electrical appliances, especially for those in which plastic materials are used in at least a part of dielectric materials or insulating materials.

The present invention will be described in more detail with reference to examples.

PREPARATION EXAMPLE

To a stainless steel-made continuous reaction vessel was added 100 g of synthetic zeolite ZSM-5 [$H^+$-type, $SiO_2/Al_2O_3$ (molar ratio)=60] and toluene was alkylated with ethylene under the following conditions:

| | |
|---|---|
| Reaction temperature | 450° C. |
| Reaction pressure | Atmospheric |
| Ethylene/toluene (mole) | 0.2 |
| WHSV | 4.5 |

The obtained reaction mixture was distilled and the fractions of boiling points below 250° C. containing unreacted toluene, ethyltoluene and polyethyltoluene were distilled off to obtain heavier products in a yield of 2.1%.

The heavier products were then distilled under reduced pressure to obtain a fraction (A) having a boiling range of 275° to 320° C. (atmospheric pressure).

According to the analysis of this fraction (A), it mainly contained diarylalkanes. The composition and properties are shown in the following.

Analytical Composition:

| | |
|---|---|
| Diarylalkanes ($C_nH_{2n-14}$) | 85.0% by weight |
| (n = 14) | (15.3) |
| (n = 15) | (43.8) |
| (n = 16) | (25.9) |
| Others | 15.0% |
| Total | 100.0% |

Properties:

| | |
|---|---|
| Bromine Value | 0.05 cg/g |
| Pour Point | below −50° C. |
| Viscosity | 4.6 cSt (at 40° C.) |
| Dielectric Breakdown Voltage | Not lower than 70 kV/2.5 mm |
| Specific Volume Resistivity | $1 \times 10^{16}\ \Omega \cdot cm$ |
| Dielectric Constant | 2.53 |
| Dielectric Loss Tangent | 0.001 (at 80° C.) |

COMPARATIVE PREPARATION EXAMPLE

Benzene and ethylene in a molar ratio of 5:1 were reacted together in a reaction vessel with stirring at 130° C. for 1 hour in the presence of aluminum chloride catalyst. After deactivation of the catalyst, unreacted benzene, ethylbenzene and polyethylbenzene were distilled off and the remainder was further distilled under a reduced pressure to obtain a fraction (B) of a boiling range of 270° to 320° C. (atmospheric pressure). The analytical composition of this fraction was as follows:

| | |
|---|---|
| 1,1-diphenylethane | 36.9% |
| 1-phenyl-1-(ethylphenyl)ethane | 32.3% |
| Others | 30.8% |
| Total | 100.0% |

EXAMPLE

Model capacitors for oil impregnation were made through a procedure that an electrode made of aluminum foil and a dielectric material made of two-ply polypropylene film (14μ thick) were wound together according to the conventional method to form capacitor elements.

These model capacitors were then impregnated in vacuo with the fractions (A) and (B) to obtain oil-filled capacitors of about 0.4 μF in electrostatic capacity.

These oil-filled capacitors were applied with alternating electric voltages and the times until they were broken down were determined.

In this test, 15 capacitors were made for each impregnating oil and the average of determined times with omitting the maximum and the minimum values was adopted as the resultant value. The results are shown in the following:

| Impregnating Oil | Breakdown Time (hrs.) |
|---|---|
| Fraction (A) | 850 |
| Fraction (B) | 320 |
| Fraction (C)* | 330 |

*Prepared by refining Fraction (B) with activated clay under conventional refining conditions for electrical insulating oils.

As will be understood from the above description and examples, the electrical insulating oil of the invention can be prepared quite easily at low cost from the heavier by-product fraction in the ethyltoluene production process and the contents of tarry substances, carbonyl compounds and unsaturated compounds are very small. Furthermore, it does not swell plastic materials to a great extent and the electrical characteristics of the fraction are good.

Therefore, the electrical insulating oil of the present invention is quite suitable as an impregnating oil for oil-filled electrical appliances, especially for those in which plastic materials are employed for at least a part of the dielectric materials or insulating materials.

What is claimed is:

1. An electrical insulating oil which is characterized in that said electrical insulating oil comprises a fraction having boiling points in the range of 270° to 350° C. which is obtained by distilling the heavier products obtained from the process for producing ethyltoluene by alkylating toluene with ethylene in the presence of synthetic zeolite catalyst.

2. The electrical insulating oil in claim 1, wherein said synthetic zeolite catalyst is crystalline aluminosilicate zeolite.

3. The electrical insulating oil in claim 1, wherein said synthetic zeolite catalyst is ZSM-5 type zeolite catalyst.

4. The electrical insulating oil in claim 1, wherein said alkylation is carried out at temperatures in the range of 300° to 650° C.

5. An oil-filled electrical appliance impregnated with an electrical insulating oil which is characterized in that said electrical insulating oil comprises a fraction having boiling points in the range of 270° to 350° C. which is obtained by distilling the heavier products obtained from the process for producing ethyltoluene by alkylating toluene with ethylene in the presence of synthetic zeolite catalyst.

6. The oil-filled electrical appliance in claim 5, wherein said synthetic zeolite catalyst is crystalline aluminosilicate zeolite.

7. The oil-filled electrical appliance in claim 5, wherein said synthetic zeolite catalyst is ZSM-5 type zeolite catalyst.

8. The oil-filled electrical appliance in claim 5, wherein said alkylation is carried out at temperatures in the range of 300° to 650° C.

9. The oil-filled electrical appliance in claim 5, wherein said appliance is an oil-filled electrical appliance in which plastic materials are used in at least a part of dielectric materials or insulating materials.

10. The oil-filled electrical appliance in claim 9, wherein said plastic materials are polyolefins.

11. The oil-filled electrical appliance in claim 10, wherein said polyolefin is polypropylene.

12. The oil-filled electrical appliance in claim 5, wherein said appliance is an oil-filled electrical capacitor.

13. The oil-filled electrical appliance in claim 5, wherein said appliance is an oil-filled electrical cable.

* * * * *